US010965041B2

(12) United States Patent
Taptic et al.

(10) Patent No.: US 10,965,041 B2
(45) Date of Patent: Mar. 30, 2021

(54) DUAL POLARIZED HORN ANTENNA WITH ASYMMETRIC RADIATION PATTERN

(71) Applicant: RF elements s.r.o., Bratislava (SK)

(72) Inventors: Juraj Taptic, Zalesie (SK); Martin Marcincak, Humenne (SK); Pavol Capek, Stupava (SK)

(73) Assignee: RF ELEMENTS S.R.O, Bratislava (SK)

( * ) Notice: Subject to any disclaimer, the term of this patent is extended or adjusted under 35 U.S.C. 154(b) by 0 days.

(21) Appl. No.: 16/597,669

(22) Filed: Oct. 9, 2019

(65) Prior Publication Data

US 2020/0112107 A1 Apr. 9, 2020

Related U.S. Application Data

(60) Provisional application No. 62/743,289, filed on Oct. 9, 2018.

(51) Int. Cl.

| | |
|---|---|
| ***H01Q 13/02*** | (2006.01) |
| ***H01Q 25/00*** | (2006.01) |
| ***H01Q 15/24*** | (2006.01) |

(52) U.S. Cl.

CPC ..... *H01Q 25/002* (2013.01); *H01Q 13/02* (2013.01); *H01Q 15/24* (2013.01)

(58) Field of Classification Search

CPC ..... H01Q 25/002; H01Q 13/02; H01Q 15/24

See application file for complete search history.

(56) References Cited

U.S. PATENT DOCUMENTS

| | | | | |
|---|---|---|---|---|
| 2,521,524 A | | 9/1950 | Kock | |
| 2,943,324 A | | 6/1960 | Sichak | |
| 3,274,602 A | | 9/1966 | Randall et al. | |
| 6,137,450 A | * | 10/2000 | Bhattacharyya ..... | H01Q 13/02 343/776 |
| 6,211,838 B1 | * | 4/2001 | Cherrette ..... | H01Q 13/0241 343/786 |

FOREIGN PATENT DOCUMENTS

| | | |
|---|---|---|
| CN | 202871984 | 4/2013 |
| WO | 2016/176717 | 11/2016 |

OTHER PUBLICATIONS

Second Written Opinion dated Jul. 7, 2020 in corresponding International PCT Patent Application PCT/IB2019/001098, 16 pages.

Urata H et al: "Multiple-Step Rectangular Horn With Two Orthogonal Sectoral Tapers for Elliptical Beam", IEICE Transactions on Electronics, Institute of Electronics, Tokyo, JP, vol. E90C, No. 2, Feb. 1, 2007 (Feb. 1, 2007), pp. 217-223.

(Continued)

*Primary Examiner* — Hoang V Nguyen

(74) *Attorney, Agent, or Firm* — Ohlandt, Greeley, Ruggiero & Perle, L.L.P.

(57) ABSTRACT

A horn-type of electromagnetic dual polarized antenna, having an asymmetric radiation pattern is provided. More specifically, the radiation pattern in the azimuth plane will have a wider beam width while the radiation pattern in the elevation plane will have a narrower beam width, and the radiation patterns for the horizontal and vertical polarizations are substantially equal.

17 Claims, 16 Drawing Sheets

(56) References Cited

OTHER PUBLICATIONS

S. Sanchez-Sevilleja et al: "Compact waveguide broadband dual-polarized horn array with a novel orthomode transducer in Ku-band for high-power SAR systems", Journal of Electromagnetic Waves and Applications, vol. 28, No. 4, Jan. 9, 2014 (Jan. 9, 2014), pp. 442-458.

Esquius-Morote Marc et al: "Orthomode Transducer and Dual-Polarized Horn Antenna in Substrate IntegratedTechnology", IEEE Transactions on Antennas and Propagation, IEEE Service Center, Piscataway, NJ, US, vol. 62, No. 10, Jul. 22, 2014 (Jul. 22, 2014) pp. 4935-4944.

International Search Report dated Mar. 12, 2020 in corresponding International PCT Patent Application PCT/IB2019/001098, 6 pages.

Written Opinion dated Mar. 12, 2020 in corresponding International PCT Patent Application PCT/IB2019/001098, 12 pages.

International Preliminary Report on Patentability dated Oct. 9, 2020 in corresponding International PCT Patent Application PCT/IB2019/001098, 12 pages.

* cited by examiner

FIG. 1
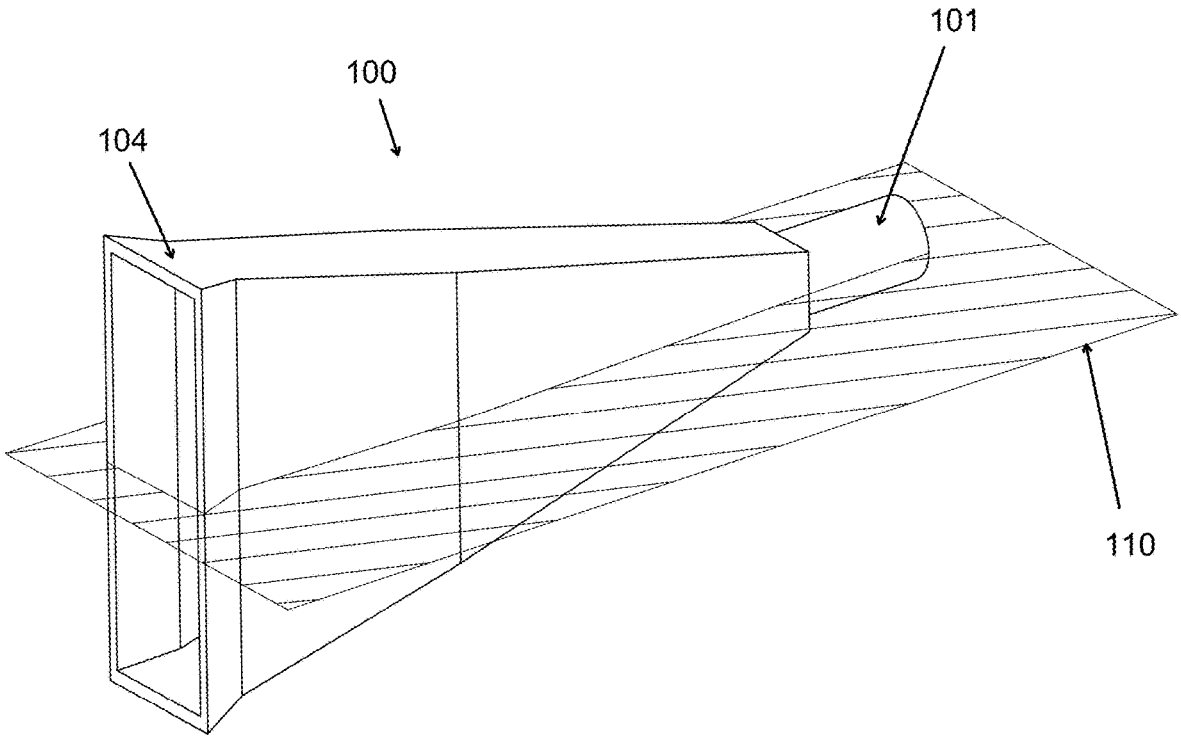
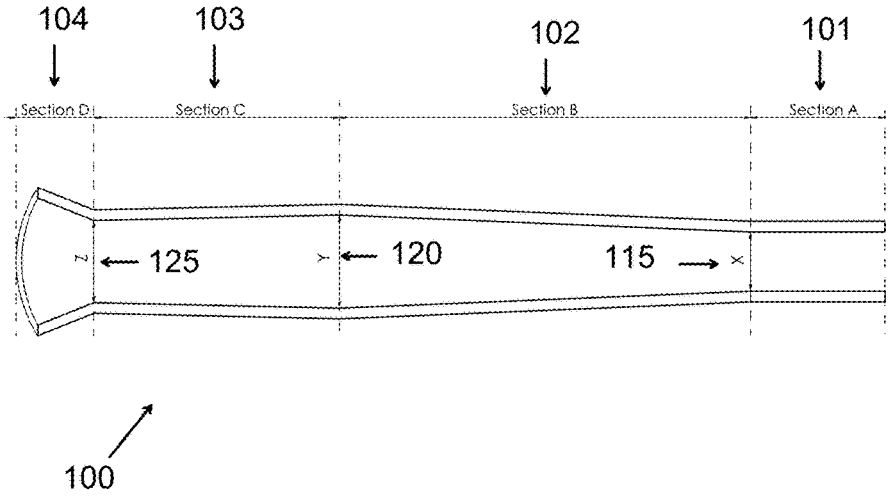
FIG. 2

FIG. 3
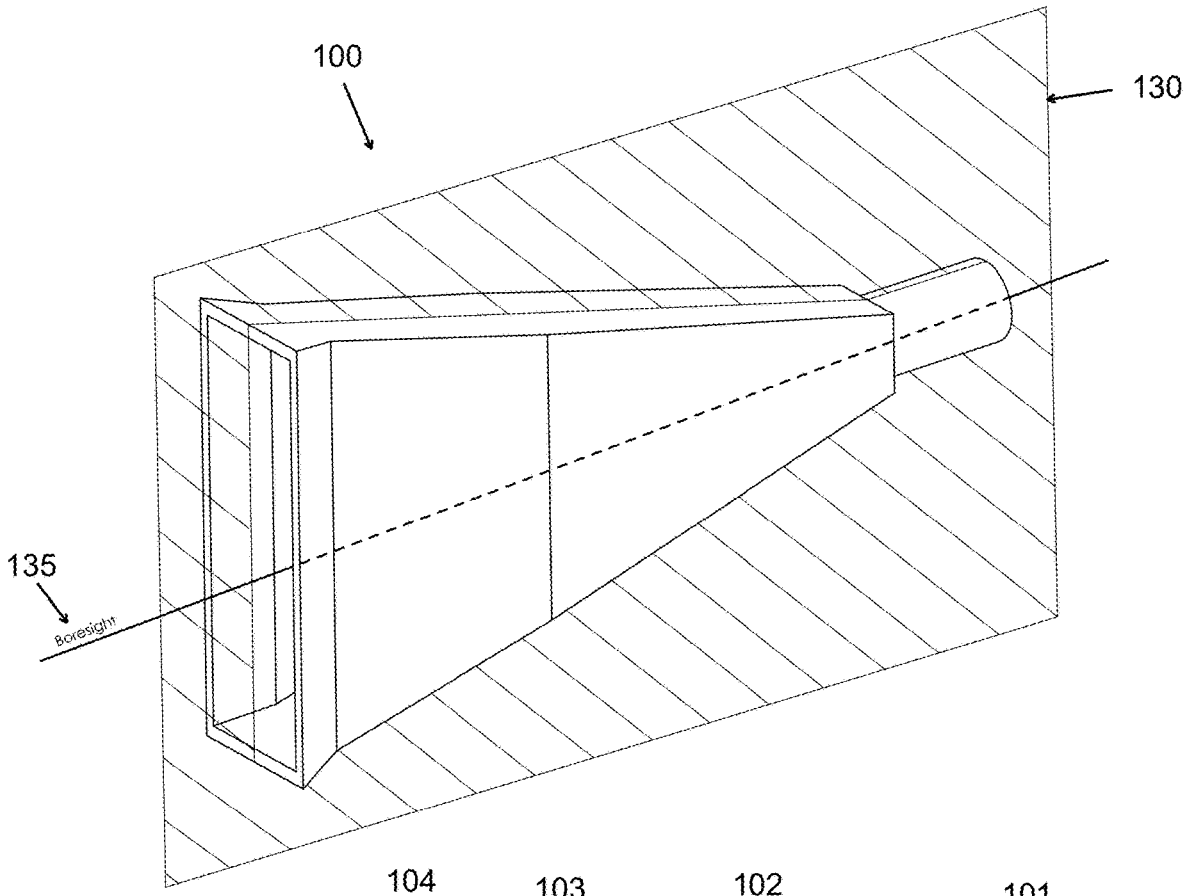
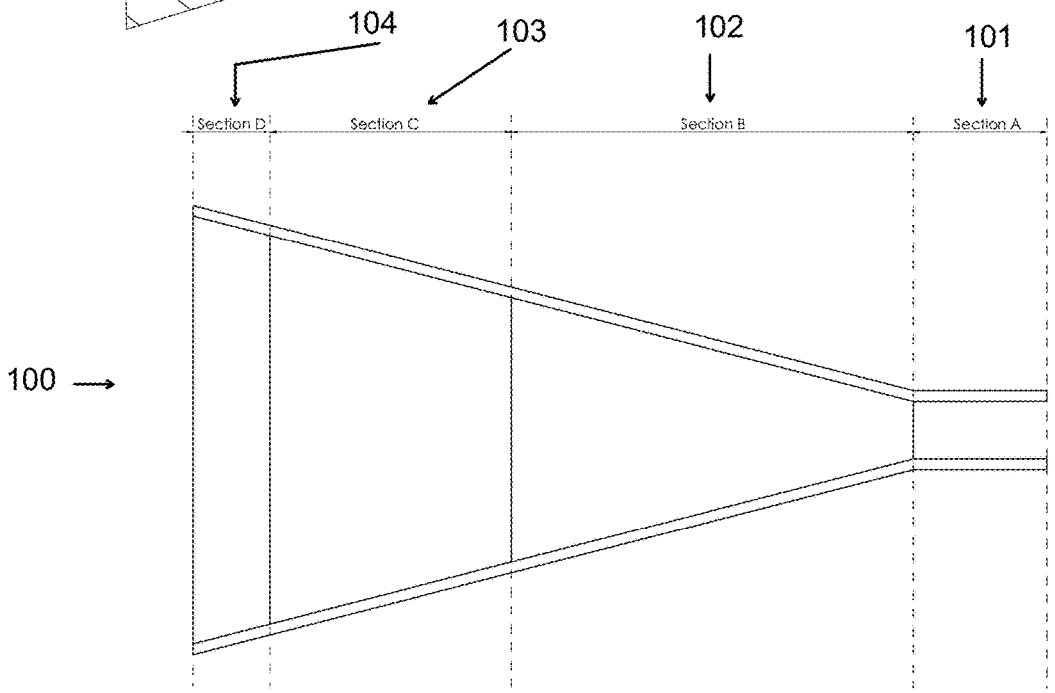
FIG. 4

FIG. 5
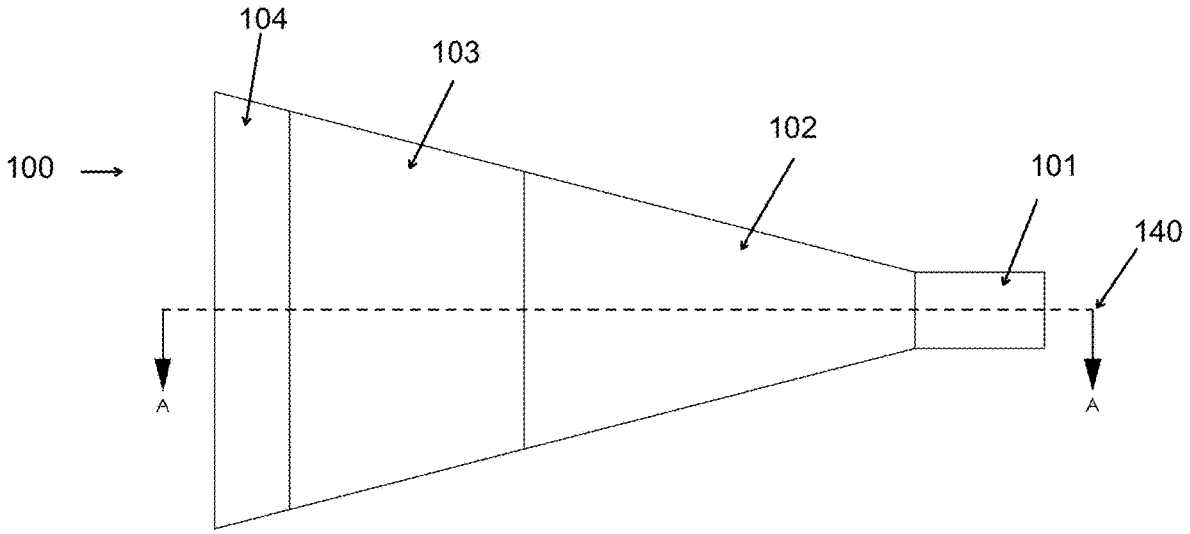
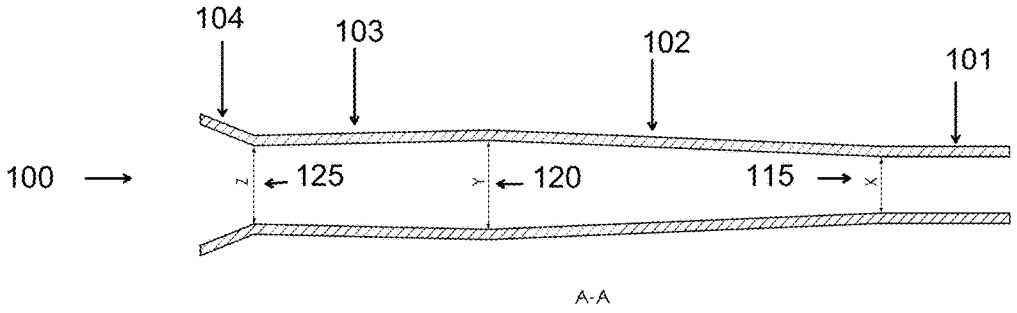
FIG. 6

FIG. 7
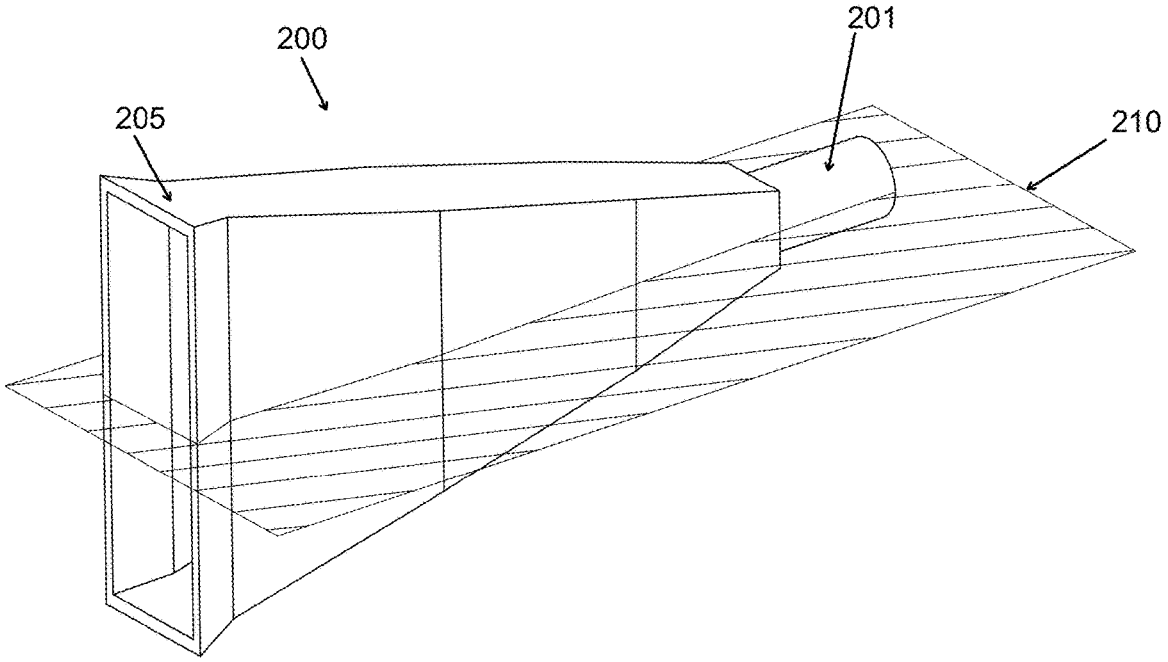
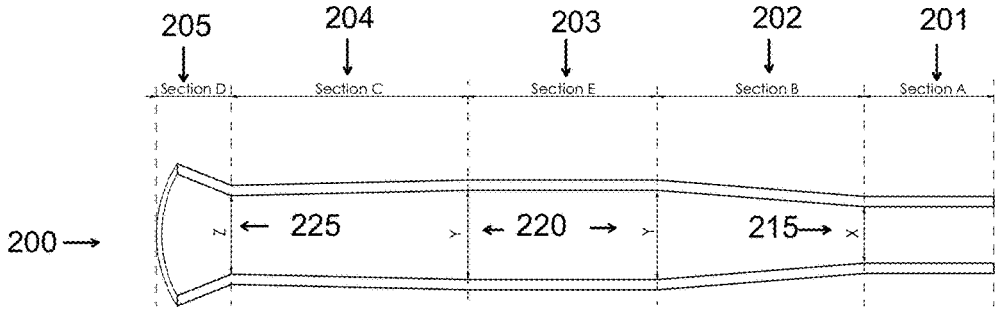
FIG. 8

FIG. 9
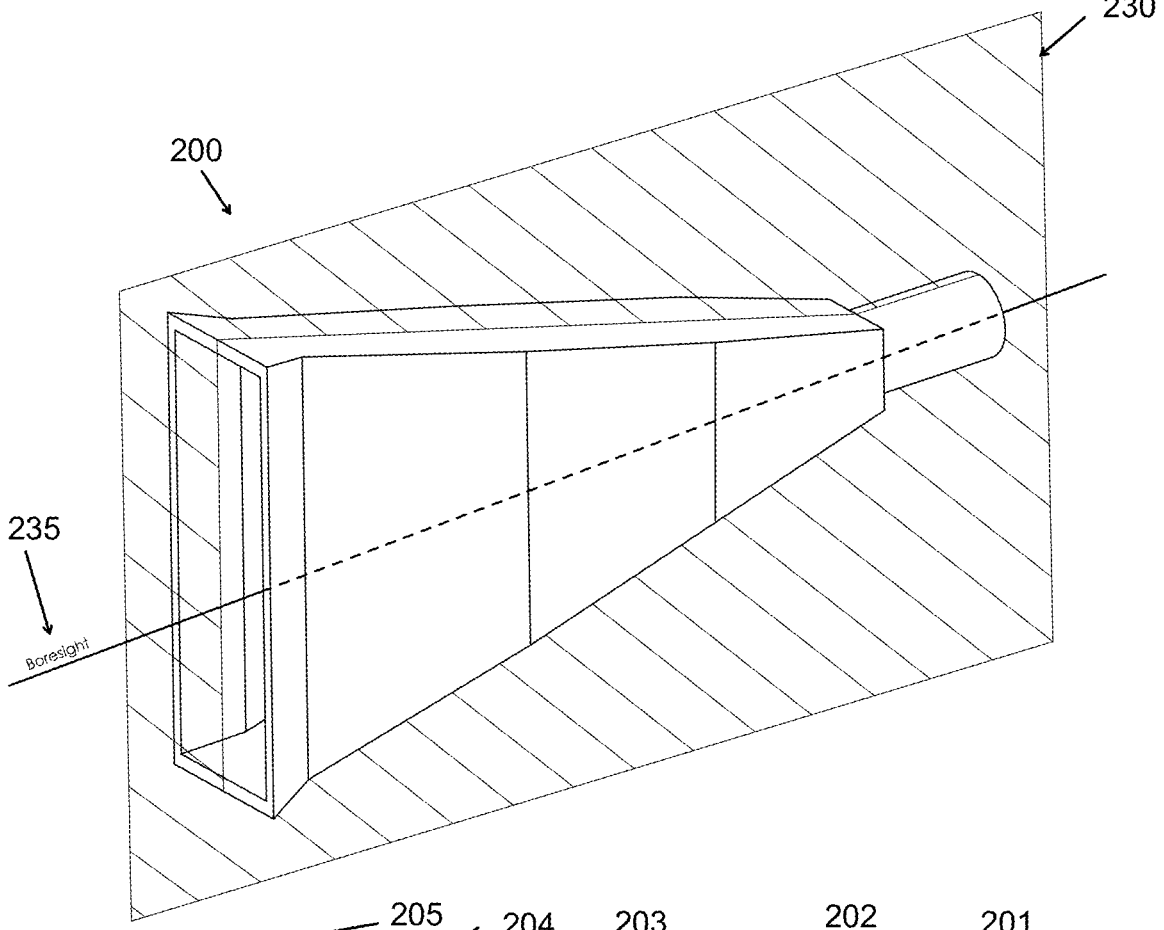
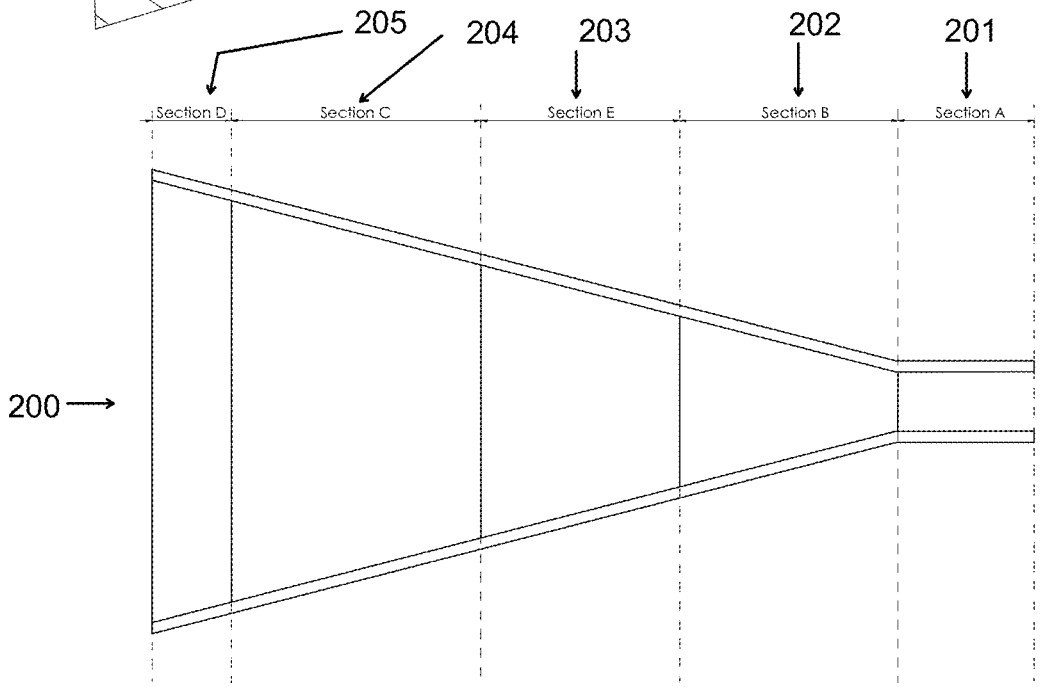
FIG. 10

FIG. 11
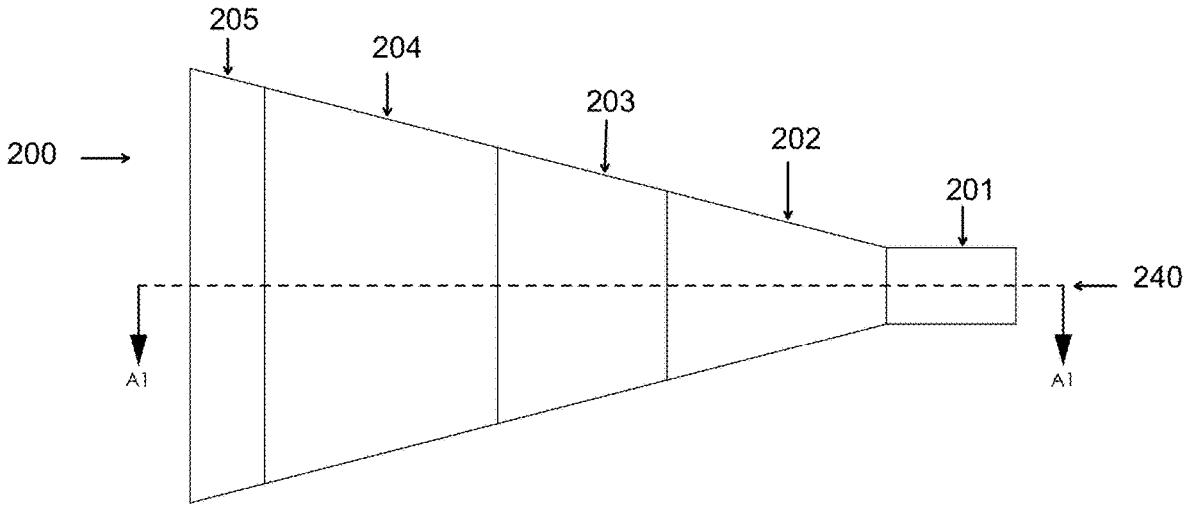
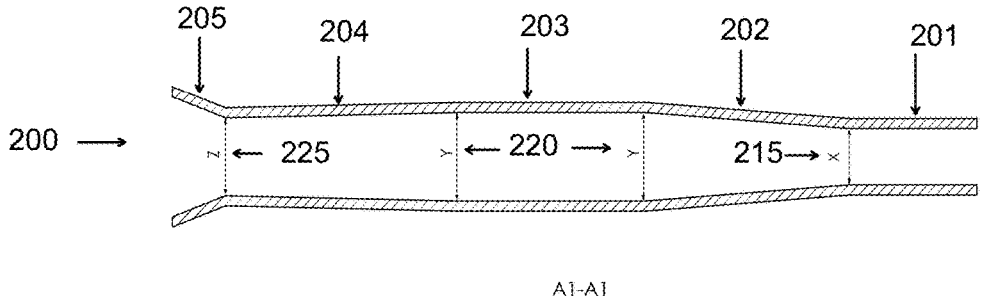
FIG. 12

HORIZONTAL POLARIZATION - AZIMUTH

HORIZONTAL POLARIZATION - ELEVATION

VERTICAL POLARIZATION - AZIMUTH

VERTICAL POLARIZATION - ELEVATION

DUAL POLARIZED HORN ANTENNA WITH ASYMMETRIC RADIATION PATTERN

CROSS REFERENCE TO RELATED APPLICATIONS

This application claims the benefit of U.S. Provisional Application Ser. No. 62/743,289 filed Oct. 9, 2018, the contents of which are incorporated by reference herein in their entirety.

BACKGROUND

1. Field of the Disclosure

The present disclosure generally relates to electromagnetic antennas. More specifically, the present disclosure relates to a horn-type of electromagnetic antenna, having an asymmetric or elliptical radiation pattern. More specifically, the radiation pattern in the azimuth plane has a wider beam width, than the radiation pattern in the elevation plane or vice versa.

2. Description of Related Art

A wireless communication network typically includes a "main" node, called Access Point, or Base Station, or EnodeB (i.e. different wireless technologies use different terminology), where the "main" node is serving multiple "side" nodes, referred to as client stations/terminals or CPEs (customer's premises equipment), also depending on particular technology. Each node comprises a transmitter connected to a suitable antenna. A "main" node antenna is required to have a specific radiation pattern to cover a particular geographic area with a signal. In the case of a terrestrial network, the main node antenna is called a sector antenna, since it creates an angular sector as a portion of a circular area around the node in the azimuth plane.

A sector antenna is often required to have angular coverage with a particular beam width, but in the elevation plane the beam should be much narrower.

Horn antennas have recently become more popular as sector antennas with symmetrical—circular—beam section and dual polarized (horizontal and vertical) antenna system to simultaneously transmit/receive two orthogonally polarized signals. Their main benefit is the substantial reduction or virtual elimination of side lobes in their radiation patterns, which ensures excellent field performance in terms of reducing interference in dense deployments.

For a dual linear polarized (i.e. horizontal and vertical) horn antenna, it is a difficult task to achieve asymmetric radiation with equal shape for both polarizations. Having identical beam shape in dual linear (horizontal and vertical) polarized antennas is necessary in order to provide the same antenna performance or the same performance of the wireless network at each point within the sector coverage.

SUMMARY

The present disclosure describes a novel dual linear polarized horn antenna structure with asymmetric radiation patterns equal for both horizontal and vertical polarizations.

A dual linear horizontal and vertical (H+V) polarized horn antenna having asymmetrical radiation patterns equal for both polarizations is provided. Horn antenna shape is not rotationally symmetric along longitudinal axis and, hence its cross-section is either oval or rectangular. When horizontally oriented by the smaller cross-section dimension, the radiation pattern in the azimuth plane will have a wider beamwidth (i.e. about 60 degrees), while the radiation pattern in the elevation plane will have a narrower beamwidth (i.e. about 15 to 20 degrees). A key characteristic is that, according to the present disclosure, the cross-section in the azimuth plane has a width or physical dimension that is narrower at the antenna mouth section than the width or physical dimension in flared sections located between the mouth and the throat as shown in FIGS. 2 and 8. The throat can have a circular cross-section shape, thus forming a circular waveguide at the input port of the antenna located on the right side of FIG. 1. In some embodiments, throat (A) can have different shapes or cross sections, such as but not limited to a square or rectangular shape.

A horn-type electromagnetic antenna, having a plurality of asymmetric radiation patterns, wherein a first radiation pattern in an azimuth plane has a wider beamwidth than a second radiation pattern in an elevation plane.

Preferably, in some embodiments the first radiation pattern is in the range between about 30 to about 90 degrees, and the second radiation pattern is in the range between about 15 to about 30 degrees. More specifically, the radiation pattern in the azimuth plane will have a wider beamwidth (i.e. about 60 degrees in some embodiments), while the radiation pattern in the elevation plane will have a narrower beamwidth (i.e. about 15 to about 20 degrees in some embodiments).

The horn-type electromagnetic antenna is a dual polarized horn antenna. The antenna is a dual linear horizontal and vertical polarized horn antenna and the first radiation pattern for the horizontal polarization and the second radiation pattern for the vertical polarization are substantially equal in shape.

The horn-type electromagnetic antenna typically comprises a mouth, throat and at least one tapered portion disposed between the mouth and throat, wherein the mouth has a width that is smaller than the width of the tapered portion.

BRIEF DESCRIPTION OF THE DRAWINGS

FIG. 1 is perspective view of an embodiment of the antenna, showing the azimuth plane.

FIG. 2 shows a cross section of the antenna of FIG. 1 in the azimuth plane.

FIG. 3 is a perspective view of the antenna FIG. 1, showing the elevation plane.

FIG. 4 shows a cross section of the antenna of FIG. 3 in the elevation plane.

FIG. 5 is a side view of the of the antenna FIG. 1.

FIG. 6 shows a cross section of the antenna of FIG. 5, in the cutting plane A-A.

FIG. 7 is perspective view of an embodiment of the antenna, showing the azimuth plane.

FIG. 8 shows a cross section of the antenna of FIG. 7 in the azimuth plane.

FIG. 9 is a perspective view of the antenna FIG. 7, showing the elevation plane.

FIG. 10 shows a cross section of the antenna of FIG. 9 in the elevation plane.

FIG. 11 is a side view of the of the antenna FIG. 7.

FIG. 12 shows a cross section of the antenna of FIG. 11, in the cutting plane A1-A1.

A component or a feature that is common to more than one drawing is indicated with the same reference number in each of the drawings.

DESCRIPTION OF THE PREFERRED EMBODIMENTS

Figure 13:
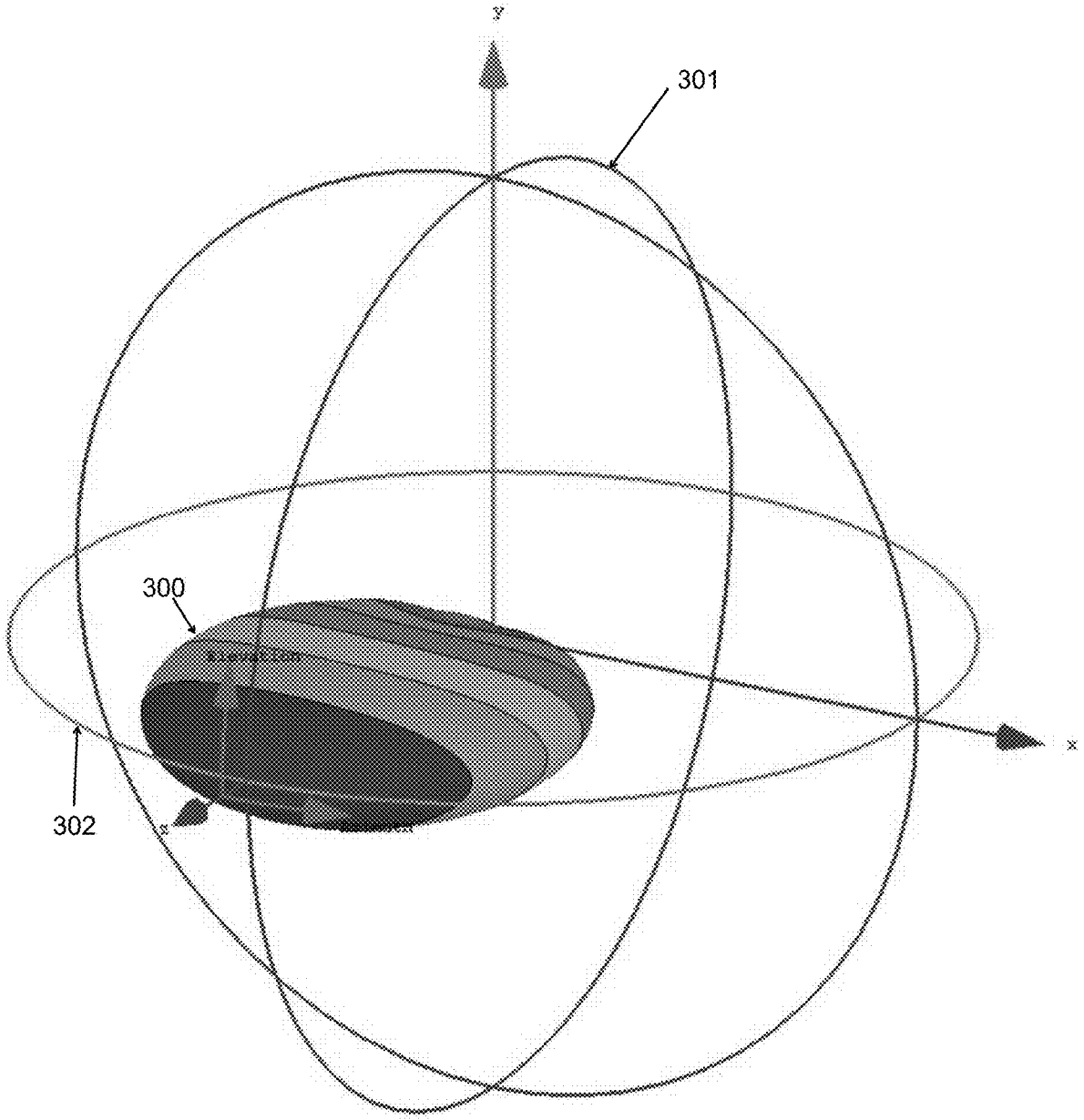
FIG. 13 shows a three-dimensional illustration of the shape of the radiation pattern of the antenna of the present disclosure for a horizontal polarization.

FIG. 1 is a perspective view of an embodiment of the disclosed antenna 100, showing an azimuth cutting plane 110 through its center. The antenna 100, has a mouth 104 and a throat 101.

A cross-section of the antenna 100 through the azimuth plane 110 is shown in FIG. 2. Section 101 on the far right side of FIG. 2 is the throat section A of the antenna, having a circular cross-section as the circular waveguide input port of the antenna, having internal width X or 115. Section 102 represents a flared region B, having an internal width Y or 120 at its left side. Section 103 is the tapered section C having an internal width Z or 125 at its left side, where it continues into the mouth 104 or section D. In some embodiments, mouth (D) of the antenna can be shaped in any commonly used shape, e.g., smoothly flared, can contain corrugations or chokes, depending on the particular requirements.

In some embodiments, dimension 115 is 36.6 millimeters (mm), dimension 120 is 54.7 (mm), and dimension 125 is 48.3 (mm).

For any embodiment of the antenna disclosed herein, width Z is always less than width Y, which allows the antenna to reach very similar or equal radiation patterns for both linear polarizations specifically horizontal and vertical polarizations. See FIGS. 13 and 18, which illustrate the significant degree similarity of the radiation patterns for both horizontal and vertical polarizations respectively. For any given value of Y when Z is smaller the azimuth radiation pattern becomes wider. Width X is always less than width Y. Width X is also always less than width Z.

FIG. 3 shows the antenna 100 with an elevation cutting plane 130 through its center, and boresight axis 135 also through its center. In some embodiments antenna 100 can be turned 90 degrees about the axis 135 in either a clockwise or counter clockwise direction from the orientation as shown in FIG. 3, so that the radiation patterns as shown in FIGS. 13-22 will invert. Or in other words the radiation pattern in the azimuth plane after the antenna is turned will become the same as the radiation pattern in the elevation plane before turn, and the radiation pattern in the elevation plane after the turn will become the same as the radiation pattern in the azimuth plane before the turn. When the antenna is turned, the radiation patterns in the azimuth and elevation planes will invert, but will remain substantially equal for both horizontal and vertical polarizations, while also retaining the asymmetrical or elliptical shape. Meaning that when turned 90 degrees, the radiation pattern in the azimuth will be narrower than the radiation pattern in the elevation plane, and thus have an asymmetrical or elliptical shape.

A cross-section of the antenna 100 through the elevation plane 130 is shown in FIG. 4. Sections 101-104, or in other words sections A-D are shown in this cross section, and correspond to the sections 101-104, as shown in FIG. 2 above. In the elevation plane, the antenna is flared between the throat and the mouth, as shown in FIGS. 4, 5, 10 and 11.

FIG. 5 shows a side view of the antenna 100 of FIG. 1, along with sections 101-104 as described above in FIGS. 2 and 4. A cutting plane A-A or axis 140 is shown through the center of antenna 100. Cutting plane A-A or axis 140 is on the azimuth plane.

FIG. 6 shows a cross section of antenna 100 taken from axis 140 or A-A as shown in FIG. 5. Sections 101-104 are shown, along with dimensions Z, Y and X as described above.

FIG. 7 is a perspective view of another embodiment of the disclosed antenna 200, showing an azimuth cutting plane 210 through its center. The antenna 200, has a mouth 205 and a throat 201.

A cross-section of the antenna 200 through the azimuth plane 210 is shown in FIG. 8. Section 201 on the far right side of FIG. 8 is the throat section A of the antenna, having a circular cross-section as the circular waveguide input port of the antenna, having internal width X or 215. Section 202 represents a flared region B, having an internal width Y or 220 at its left side. Section 203 represents another region E, also having an internal width Y or 220 at its left side. Section 204 is the tapered section C having an internal width Z or 225 at its left side, where it continues into the mouth 205 or section D.

In some embodiments, dimension 215 is 36.6 (mm), dimension 220 is 53.6 (mm), and dimension 225 is 45.1 (mm).

In some embodiments, having an internal section of the antenna with a constant dimension Y in section E can have a positive effect on the stability of antenna parameters over its frequency range. In other words, in some embodiments, beam width and antenna gain do not vary within the frequency range of the antenna. Furthermore, it can aid in achieving equal radiation parameters for both polarizations of the antenna. Waves travelling in a waveguide tend to stabilize and then travel undistorted through the waveguide when they have a sufficiently long portion of waveguide of constant dimensions such as dimension Y in this embodiment.

In some embodiments, internal widths Y in sections B and E can be equal, larger or smaller to each other and, in general, a number of these sections can be larger than that shown in FIG. 8. In some embodiments, mouth (D) of the antenna can be shaped in any commonly used shape, e.g., smoothly flared, can contain corrugations or chokes, depending on the particular requirements.

As described above, width Z is always less than width Y, which allows the antenna 200 to reach very similar or equal radiation patterns for both linear polarizations specifically horizontal and vertical polarizations. See FIGS. 13 and 18, which illustrate the significant degree similarity of the radiation patterns for both horizontal and vertical polarizations respectively. For any given value of Y when Z is smaller the azimuth radiation pattern becomes wider. Width X is always less than width Y. Width X is also always less than width Z.

In some embodiments, dimension X, as shown in FIGS. 2 and 8, or in other words the diameter of the feeding waveguide determines the lower cutoff frequency. Any electromagnetic waves with a lower frequency than this do not propagate through the waveguide. Increasing X also increases the lowest frequency that can propagate.

FIG. 9 shows the antenna 200 with an elevation cutting plane 230 through its center, and boresight axis 235 also through its center. In some embodiments antenna 200 can be turned 90 degrees about the axis 235 in either a clockwise or counter clockwise direction from the orientation as shown in FIG. 9, so that the radiation patterns as shown in FIGS. 13-22 will invert. Or in other words the radiation pattern in the azimuth plane after the antenna is turned will become the same as the radiation pattern in the elevation plane before turn, and the radiation pattern in the elevation plane after the turn will become the same as the radiation pattern in the azimuth plane before the turn. When the antenna is turned, the radiation patterns in the azimuth and elevation planes will invert, but will remain substantially equal for both horizontal and vertical polarizations, while also retaining the asymmetrical or elliptical shape. Meaning that when turned 90 degrees, the radiation pattern in the azimuth will be narrower than the radiation pattern in the elevation plane, and thus have an asymmetrical or elliptical shape.

A cross-section of the antenna 200 through the elevation plane 230 is shown in FIG. 10. Sections 201-205, or in other words sections A, B, E, C and D are shown in this cross section, and correspond to the sections 201-205, as shown in FIG. 9 above.

FIG. 11 shows a side view of the antenna 200 of FIG. 7, along with sections 201-205 as described above in FIGS. 8 and 10. A cutting plane A1-A1 or axis 240 is shown through the center of antenna 200. Cutting plane or axis 240 is on the azimuth plane.

FIG. 12 shows a cross section of antenna 200 taken from axis 240 or A1-A1 as shown in FIG. 11. Sections 201-205 are shown, along with dimensions Z, Y and X as described above. As depicted in FIGS. 2, 6, 8 and 12, the width Z in section C is smaller than is width of tapered portion Y in Section B or E, or in other words, there is a flared portion in section C followed by the tapered portion Y disposed between throat X and dimension Z in section C in the azimuth plane.

FIG. 13 shows a three-dimensional illustration 300 of the shape of the radiation pattern of the antenna of the present disclosure for a horizontal polarization, on axis x, y and z. Elevation plane 301 is shown, as defined by axis y and z, along with azimuth plane 302 as defined by axis x and z.

Figure 14:
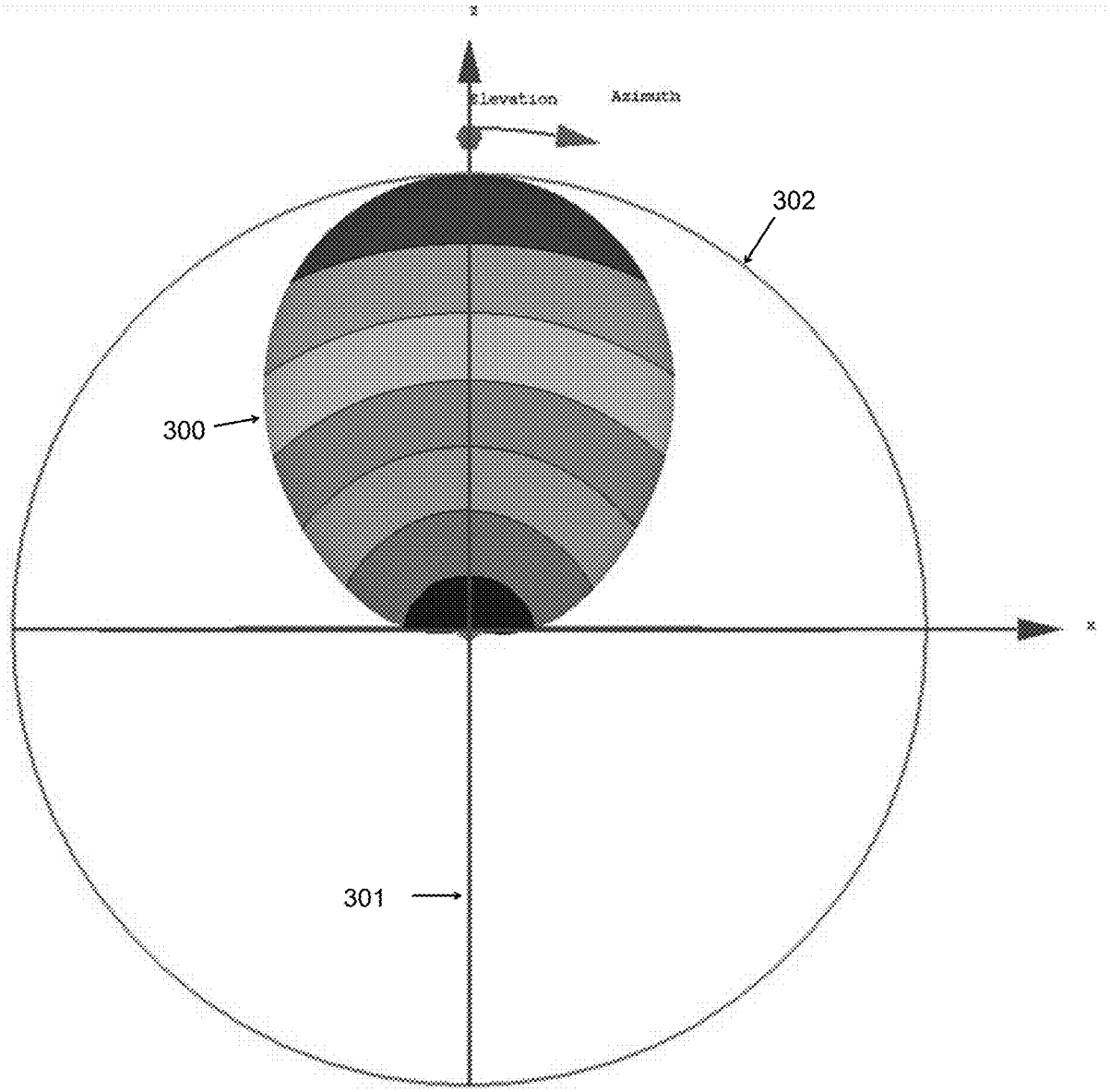
FIG. 14 shows a top view of the three-dimensional radiation pattern of FIG. 13 in the azimuth plane.

FIG. 14 shows a top view of the shape of the three-dimensional radiation pattern 300 of FIG. 13 in the azimuth plane 302. In some embodiments the beam width in the azimuth plane can be in a range of 30-90 degrees, 30-45 degrees, 30-60 degrees, or 30 degrees, 45 degrees, 60 degrees, or 90 degrees, as desired.

Figure 15:
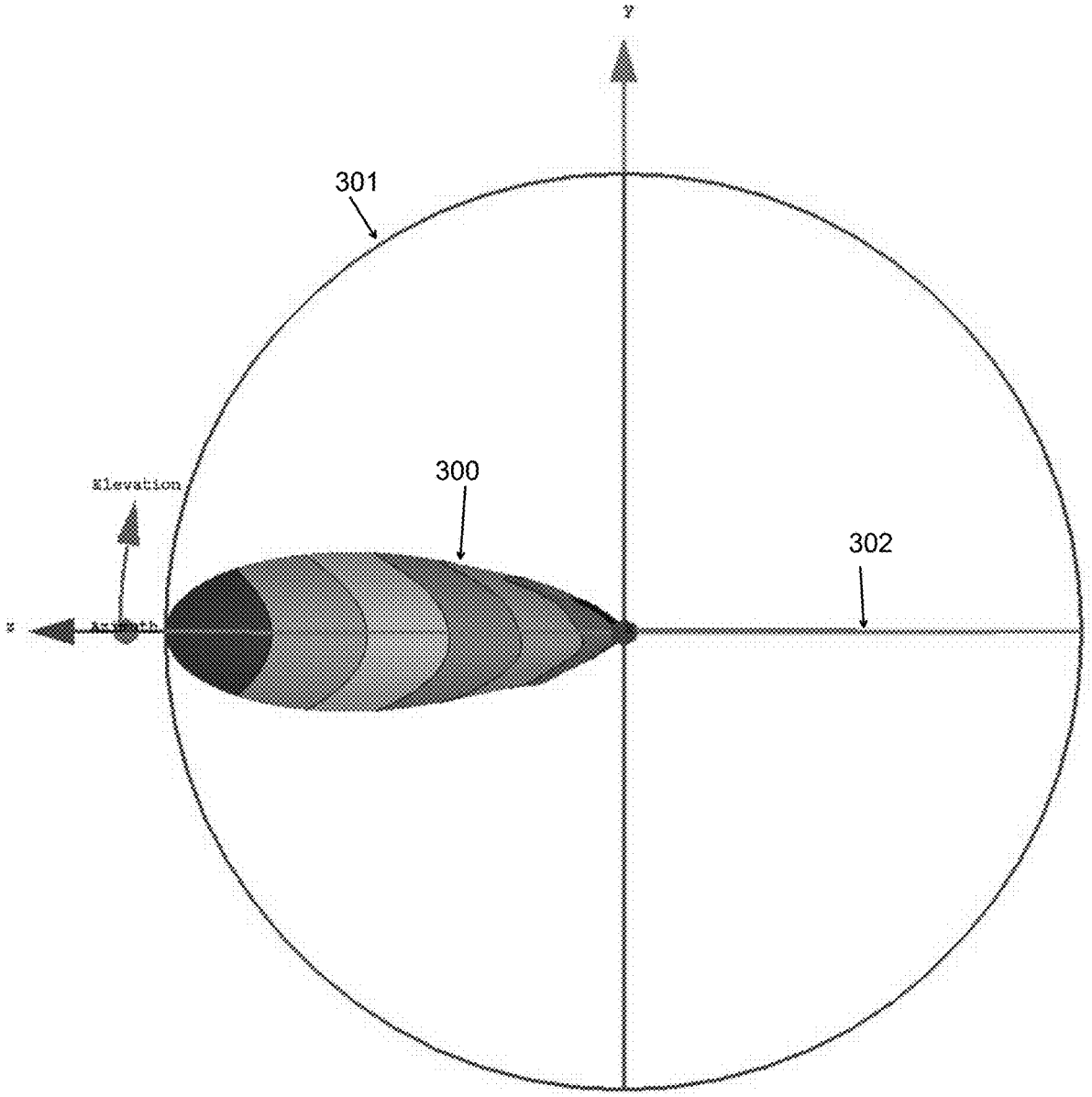
FIG. 15 shows a side view of three-dimensional radiation pattern of FIG. 13 in the elevation plane.

FIG. 15 shows a side view of the shape of the three-dimensional radiation pattern 300 of FIG. 13 in the elevation plane 301.

Figure 16:
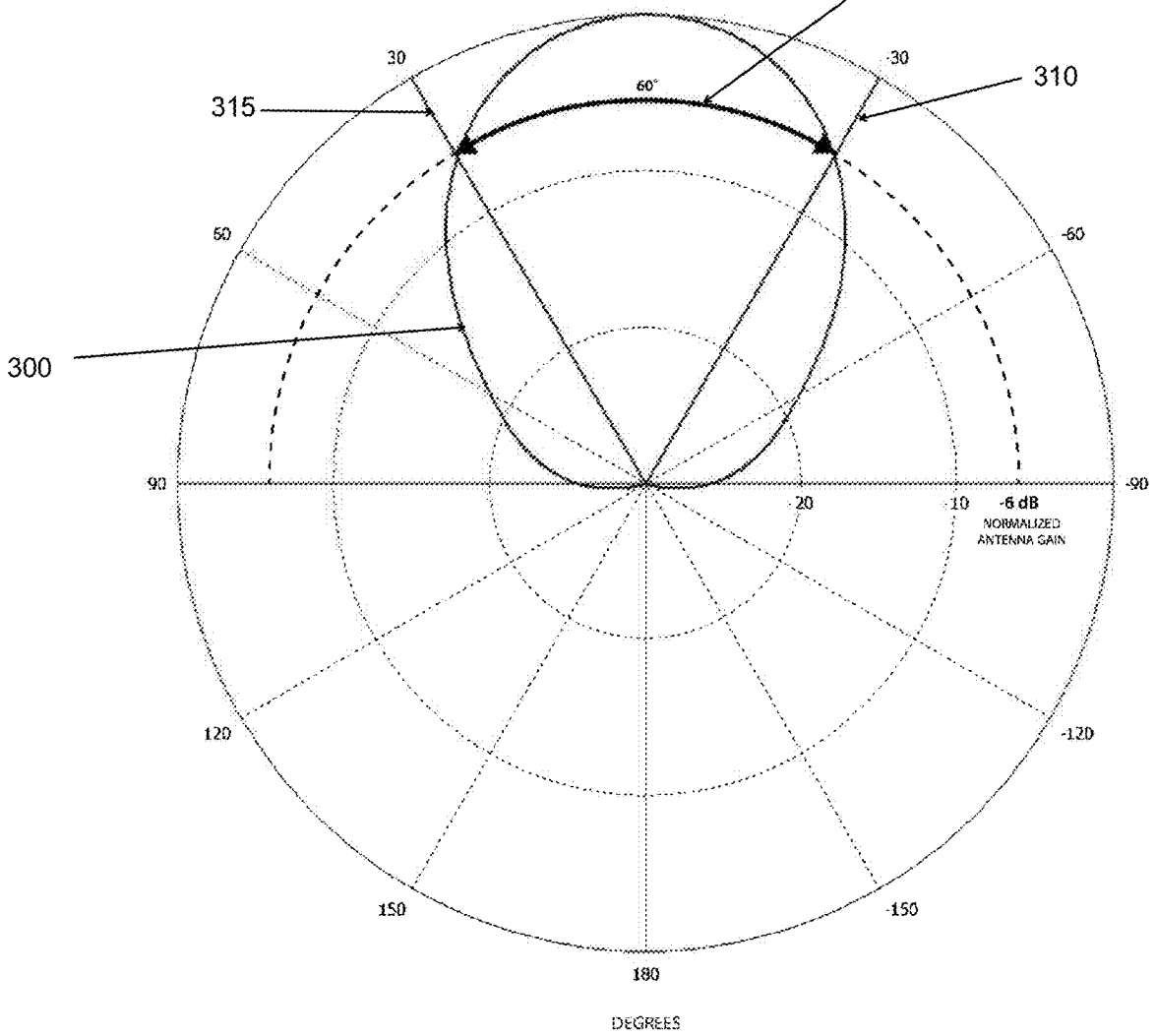
FIG. 16 shows a polar graph and the shape of the radiation pattern in the azimuth plane of the antenna of the present disclosure for a horizontal polarization.

FIG. 16 shows a polar graph and the shape of the radiation pattern 300 in the azimuth plane 302 of the antenna of the present disclosure for a horizontal polarization. The beam width 320 is measured from guidelines 310 and 315 as shown. Guidelines 310 and 315 are measured at the point on the graph, at which the antenna gain is at −6 dB. The angle or beam width 320 between these two guidelines is 60 degrees.

Figure 17:
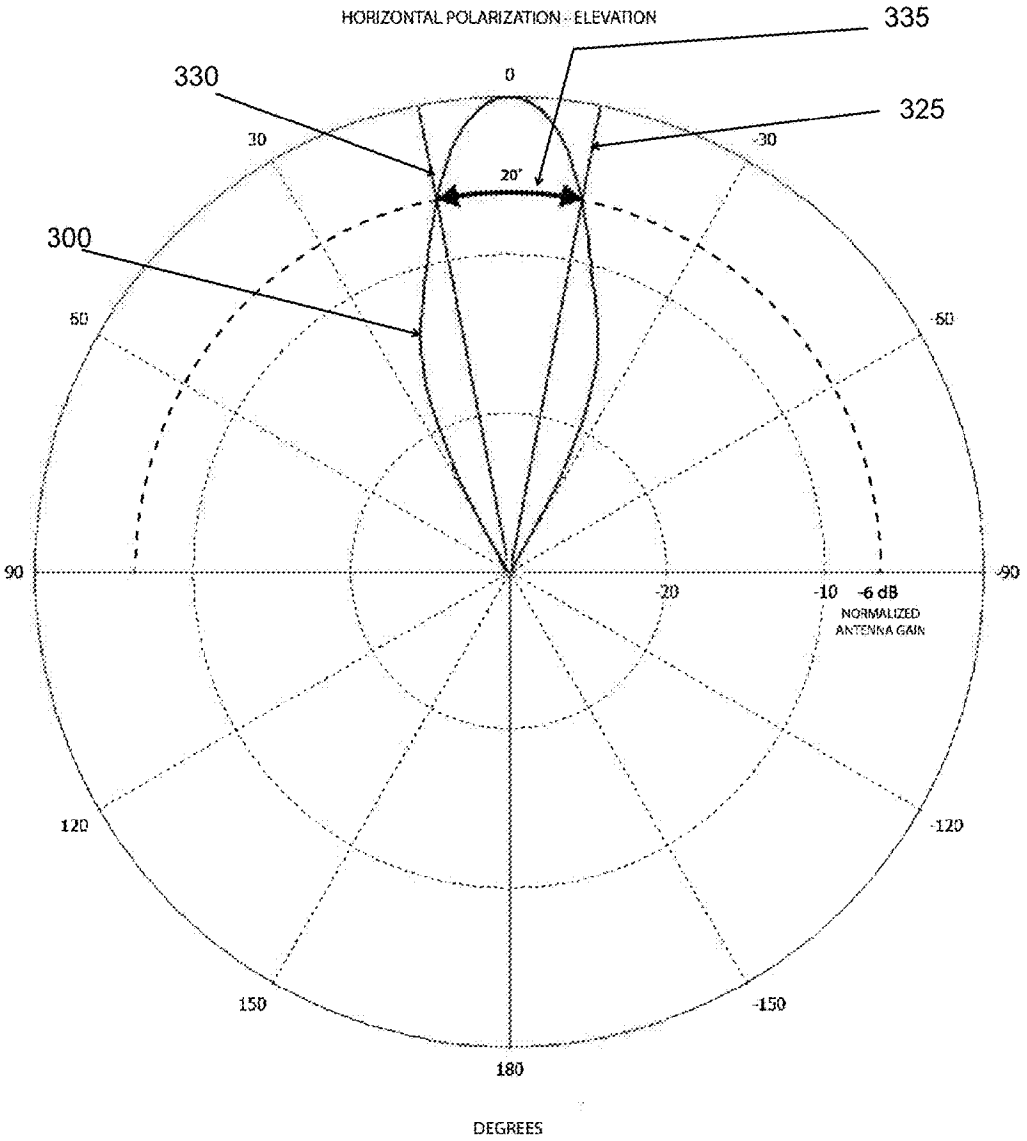
FIG. 17 shows a polar graph and the shape of the radiation pattern in the elevation plane of the antenna of the present disclosure for a horizontal polarization.

FIG. 17 shows a polar graph and the shape of the radiation pattern 300 in the elevation plane 301 of the antenna of the present disclosure for a horizontal polarization. The beam width 335 is measured from guidelines 325 and 330 as shown. Guidelines 325 and 330 are measured at the point on the graph, at which the antenna gain is at −6 dB. The angle or beam width 335 between these two guidelines is 20 degrees.

Figure 18:
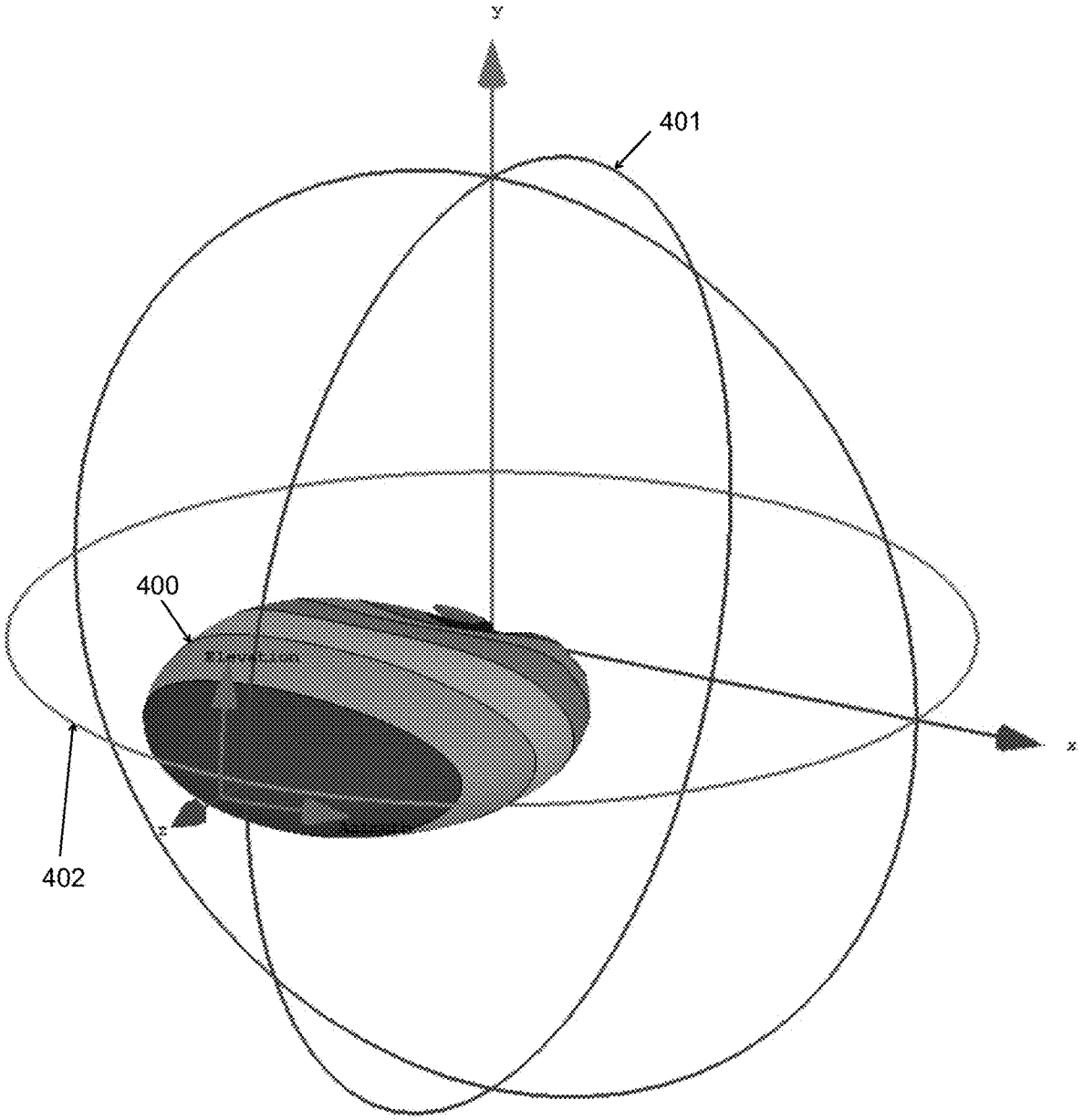
FIG. 18 shows a three-dimensional illustration of the shape of the radiation pattern of the antenna of the present disclosure for a vertical polarization.

FIG. 18 shows a three-dimensional illustration 400 of the shape of the radiation pattern of the antenna of the present disclosure for a vertical polarization, on axis x, y and z. Elevation plane 401 is shown, as defined by axis y and z, along with azimuth plane 402 as defined by axis x and z.

Figure 19:
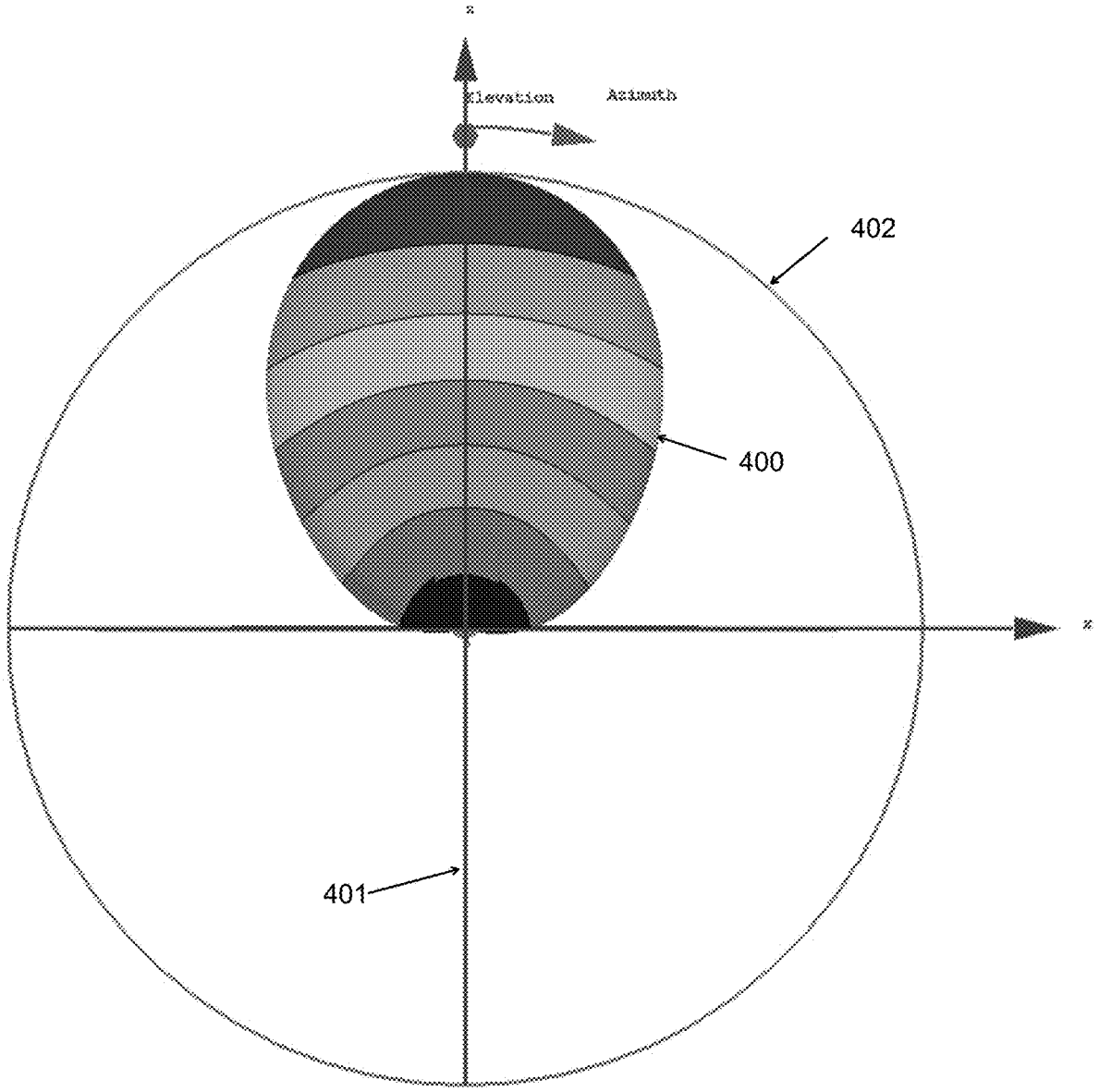
FIG. 19 shows a top view of the three-dimensional radiation pattern of FIG. 18 in the azimuth plane.

FIG. 19 shows a top view of the shape of the three-dimensional radiation pattern 400 of FIG. 18 in the azimuth plane 402. In some embodiments the beam width in the azimuth plane can be in a range of 30-90 degrees, 30-45 degrees, 30-60 degrees, or 30 degrees, 45 degrees, 60 degrees, or 90 degrees, as desired.

Figure 20:
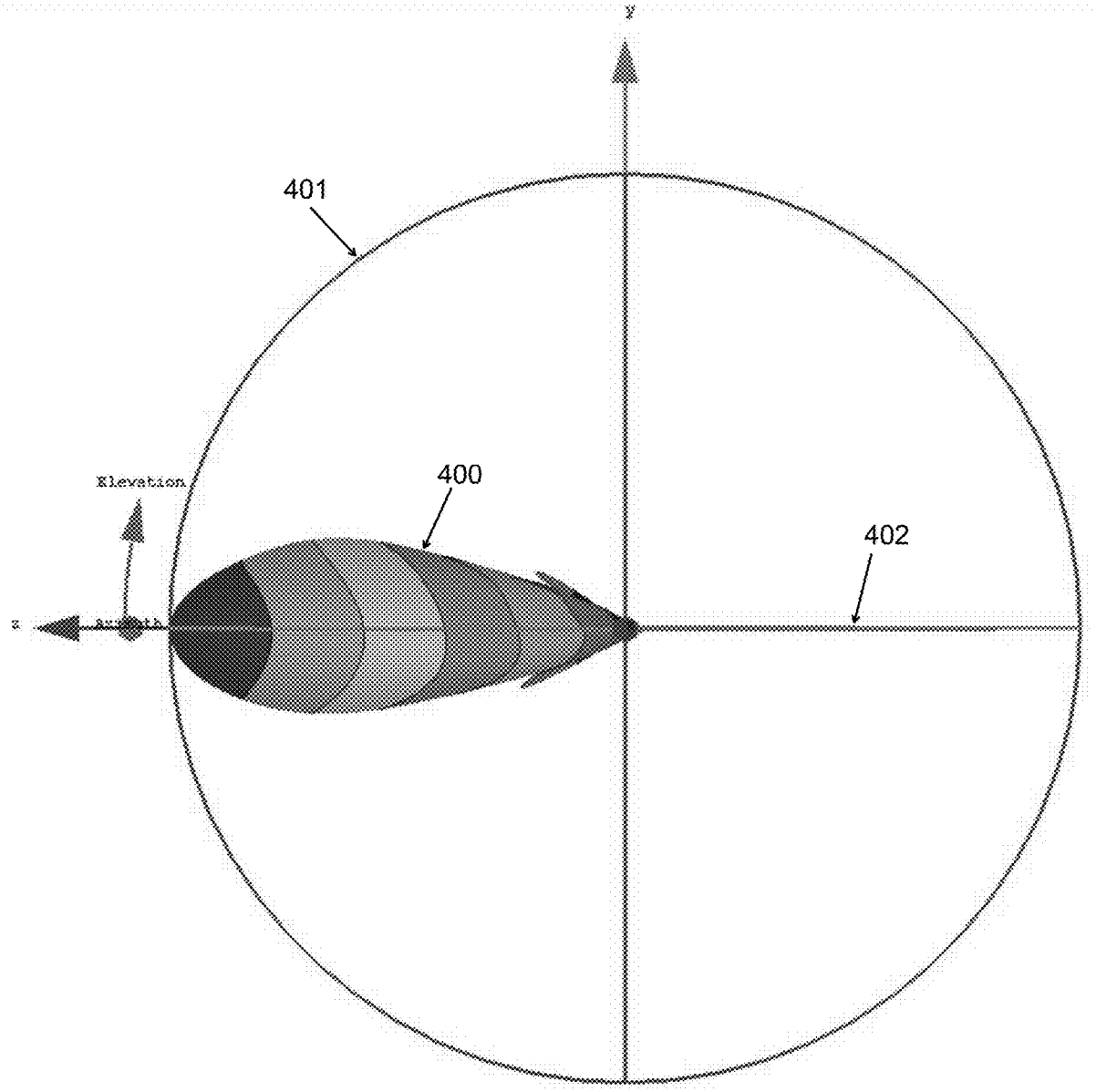
FIG. 20 shows a side view of three-dimensional radiation pattern of FIG. 18 in the elevation plane.

FIG. 20 shows a side view of the shape of the three-dimensional radiation pattern 400 of FIG. 18 in the elevation plane 401.

Figure 21:
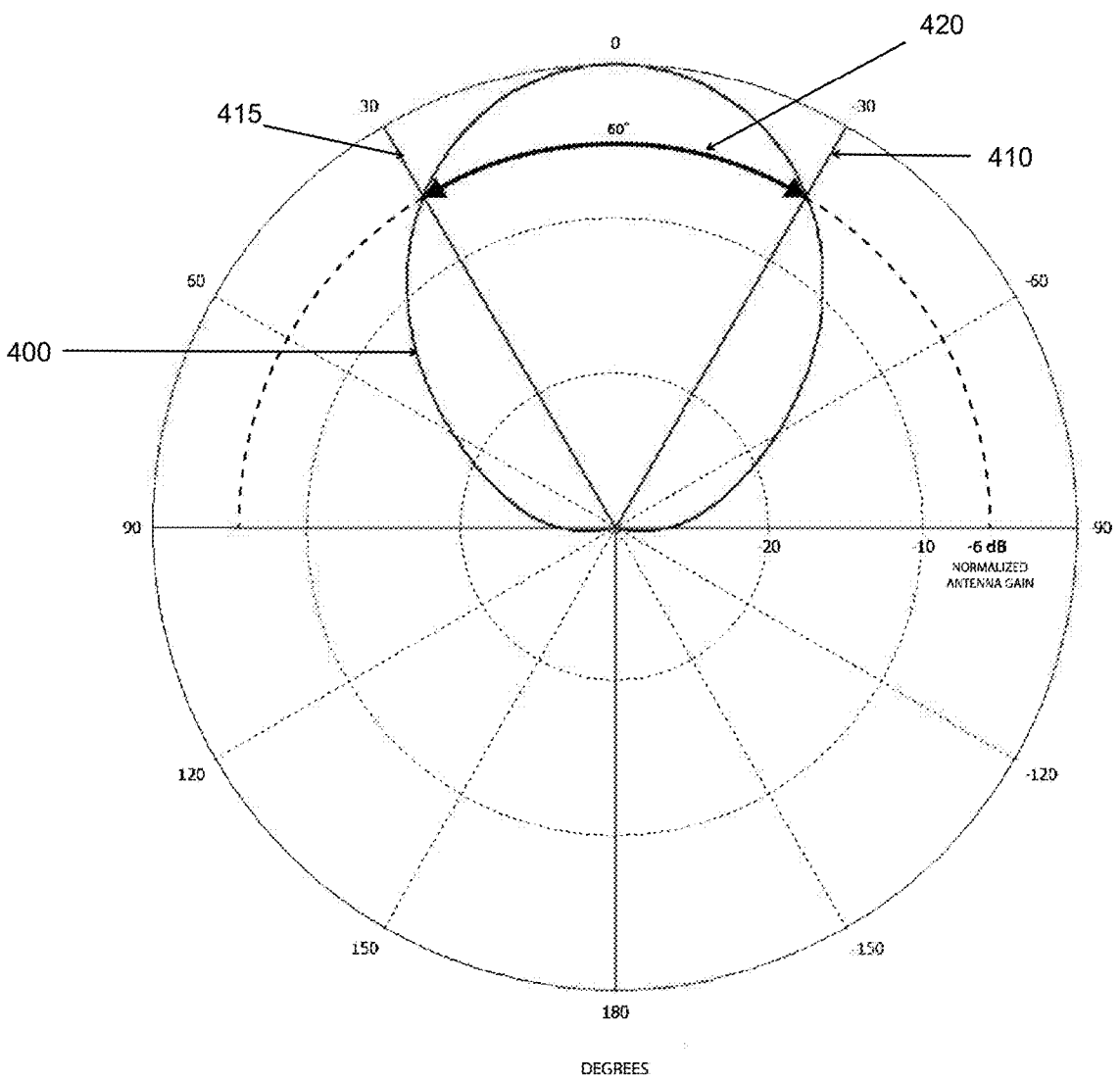
FIG. 21 shows a polar graph and the shape of the radiation pattern in the azimuth plane of the antenna of the present disclosure for a vertical polarization.

FIG. 21 shows a polar graph and the shape of the radiation pattern 400 in the azimuth plane 402 of the antenna of the present disclosure for a horizontal polarization. The beam width 420 is measured from guidelines 410 and 415 as shown. Guidelines 410 and 415 are measured at the point on the graph, at which the antenna gain is at −6 dB. The angle or beam width 420 between these two guidelines is 60 degrees.

Figure 22:
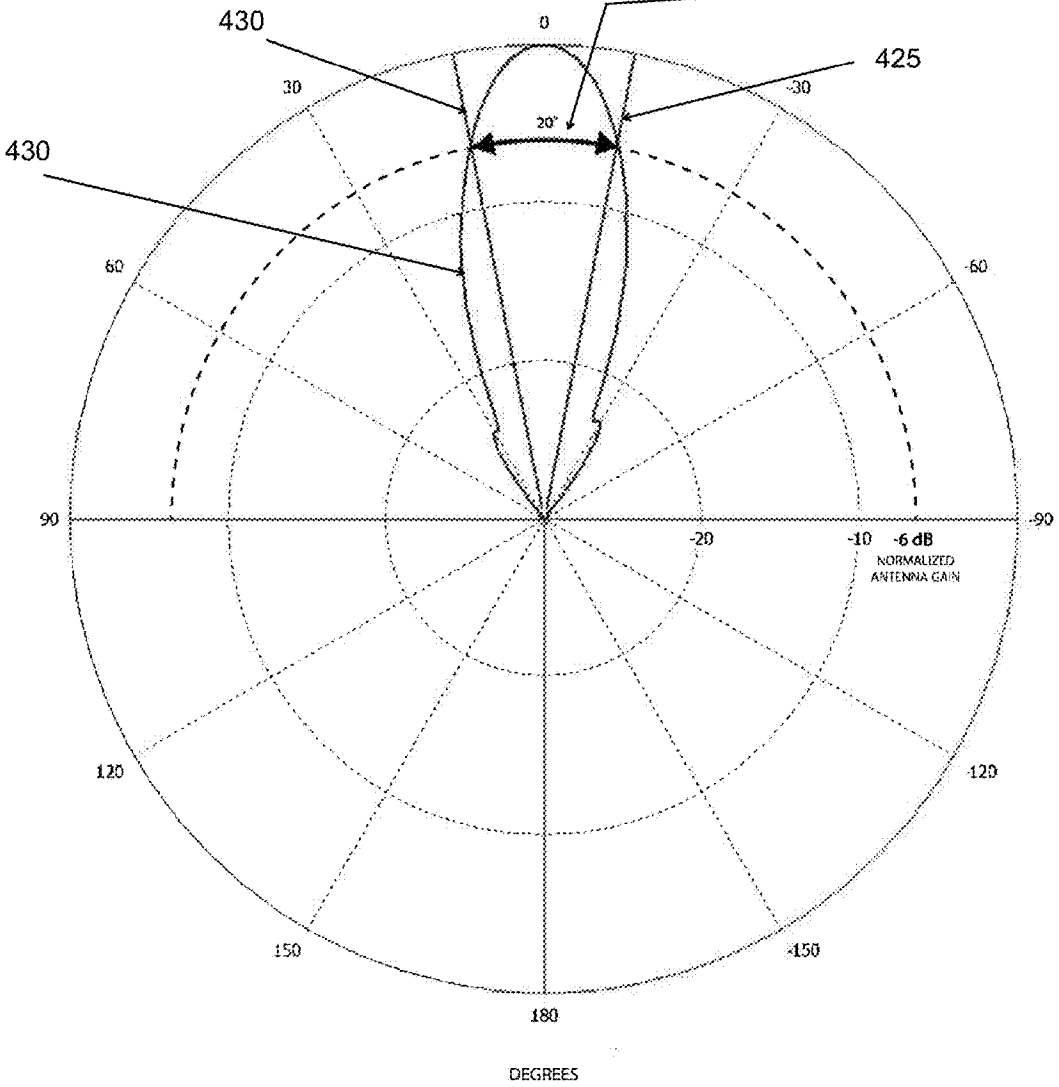
FIG. 22 shows a polar graph and the shape of the radiation pattern in the elevation plane of the antenna of the present disclosure for a vertical polarization.

FIG. 22 shows a polar graph and the shape of the radiation pattern 400 in the elevation plane 401 of the antenna of the present disclosure for a vertical polarization. The beam width 435 is measured from guidelines 425 and 430 as shown. Guidelines 425 and 430 are measured at the point on the graph, at which the antenna gain is at −6 dB. The angle or beam width 435 between these two guidelines is 20 degrees.

In some embodiments, the beam width for both horizontal and vertical polarizations, when measured from the −6 dB mark, do not differ from each other by more than 1 dB. As shown in FIGS. 16 and 21, the azimuth beam width for both horizontal and vertical polarizations, when measured from the −6 dB mark, are both measured to be 60 degrees. Similarly, as shown in FIGS. 17 and 22, the elevation beam width for both horizontal and vertical polarizations when measured from the −6 dB mark, are both measured to be 20 degrees. Therefore while the radiation patterns are asymmetrical or elliptical with regards to comparing the azimuth beam widths to the elevation beam widths, they also have equal, or substantially equal beam widths or beam characteristics when comparing corresponding azimuth beam widths and corresponding elevation beam widths, for both horizontal and vertical polarizations.

It should also be noted that the terms “first”, “second”, “third”, “upper”, “lower”, and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A horn-type electromagnetic dual-polarized horn antenna, having linear horizontal and vertical polarization, comprising a plurality of asymmetric radiation patterns, including a first radiation pattern in an azimuth plane having a wider beam width than a second radiation pattern in an elevation plane for a horizontal polarization, and a third radiation pattern in the azimuth plane having a wider beam width than a fourth radiation pattern in the elevation plane for a vertical polarization;

wherein the antenna further comprises a body having a pair of side walls opposite each other including a first portion and a second portion;

a top wall and a bottom wall opposite each other;

a throat and a mouth;

wherein the first portion has a first portion width, the mouth has a mouth width and the throat has a throat width;

wherein the first portion of the pair of side walls linearly tapers from the throat width to the first portion width with respect to the azimuth plane;

wherein the second portion of the pair of side walls linearly tapers from the first portion width to the mouth width with respect to the azimuth plane;

wherein the mouth width is smaller than the first portion width, and the throat width is smaller than the mouth width.

2. The horn-type electromagnetic dual-polarized antenna according to claim 1, wherein the plurality of asymmetric radiation patterns are elliptical radiation patterns.

3. The horn-type electromagnetic dual-polarized antenna according to claim 1, wherein the first and third radiation patterns have beamwidths that are in a range between about 30 to about 90 degrees when measured at a 6 dB drop from maximum antenna gain, and the second and fourth radiation patterns have beamwidths that are in a range between about 15 to about 30 degrees.

4. The horn-type electromagnetic dual-polarized antenna according to claim 1, wherein the first radiation pattern and the third radiation pattern are substantially equal for both the horizontal and vertical polarizations, and the second radiation pattern and the fourth radiation pattern are substantially equal for both the horizontal and vertical polarizations.

5. The horn-type electromagnetic dual-polarized antenna according to claim 1, further comprising a boresight axis running through a center of the mouth and through a center of the throat; wherein the antenna is turned 90 degrees about the boresight axis, so that the first radiation pattern in the azimuth plane is a narrower beam width than the second radiation pattern in the elevation plane for the horizontal polarization, and the third radiation pattern in the azimuth plane is a narrower beam width than the fourth radiation pattern in the elevation plane for the vertical polarization.

6. The horn-type electromagnetic dual-polarized antenna according to claim 1, wherein the antenna further comprises a mouth height and a throat height;

wherein the top and bottom walls linearly taper from the throat height to the mouth height with respect to the elevation plane; and wherein the throat height is smaller than the mouth height.

7. A horn-type electromagnetic dual-polarized horn antenna, having linear horizontal and vertical polarization, comprising a plurality of asymmetric radiation patterns, including a first radiation pattern in an azimuth plane having a narrower beam width than a second radiation pattern in an elevation plane for a horizontal polarization, and a third radiation pattern in the azimuth plane having a narrower beam width than a fourth radiation pattern in the elevation plane for a vertical polarization;

wherein the antenna further comprises a body having a pair of side walls opposite each other including a first portion and a second portion;

a top wall and a bottom wall opposite each other;

a throat and a mouth;

wherein the first portion has a first portion width, the mouth has a mouth width and the throat has a throat width;

wherein the first portion of the pair of side walls linearly tapers from the throat width to the first portion width with respect to the elevation plane;

wherein the second portion of the pair of side walls linearly tapers from the first portion width to the mouth width with respect to the elevation plane;

wherein the mouth width is smaller than the first portion width, and the throat width is smaller than the mouth width.

8. The horn-type electromagnetic dual-polarized antenna according to claim 7, wherein the plurality of asymmetric radiation patterns are elliptical radiation patterns.

9. The horn-type electromagnetic dual-polarized antenna according to claim 7, wherein the first and third radiation patterns are in a range between about 15 to about 30 degrees, and the second and fourth radiation patterns are in a range between about 30 to about 90 degrees.

10. The horn-type electromagnetic dual-polarized antenna according to claim 7, wherein the first radiation pattern and the third radiation pattern are substantially equal for both the horizontal and vertical polarizations, and the second radiation pattern and the fourth radiation pattern are substantially equal for both the horizontal and vertical polarizations.

11. The horn-type electromagnetic dual-polarized antenna according to claim 7, wherein the antenna further comprises a mouth height and a throat height;

wherein the top and bottom walls linearly taper from the throat height to the mouth height with respect to the azimuth plane; and wherein the throat height is smaller than the mouth height.

12. A horn-type electromagnetic dual-polarized horn antenna, having linear horizontal and vertical polarization, comprising:

a body having a pair of side walls opposite each other including a first portion and a second portion;

a top wall and a bottom wall opposite each other; and a throat and a mouth;

wherein the first portion has a first portion width, the mouth has a mouth width and the throat has a throat width;

wherein the first portion of the pair of side walls smoothly tapers from the throat width to the first portion width with respect to an azimuth plane, wherein the second portion of the pair of side walls smoothly tapers from the first portion width to the mouth width with respect to the azimuth plane;

wherein the mouth width is smaller than the first portion width, and the throat width is smaller than the mouth width.

13. The horn-type electromagnetic dual-polarized antenna according to claim 12, wherein the antenna produces a plurality of asymmetric radiation patterns having linear horizontal and vertical polarizations, including a first radiation pattern in the azimuth plane having a wider beam width than a second radiation pattern in an elevation plane for a horizontal polarization, and a third radiation pattern in the azimuth plane having a wider beam width than a fourth radiation pattern in the elevation plane for a vertical polarization.

14. The horn-type electromagnetic dual-polarized antenna according to claim 12, wherein the first radiation pattern and the third radiation pattern are substantially equal for both the horizontal and vertical polarizations, and the second radiation pattern and the fourth radiation pattern are substantially equal for both the horizontal and vertical polarizations.

15. The horn-type electromagnetic dual-polarized antenna according to claim 12, wherein the antenna further comprises a mouth height and a throat height;

wherein the top and bottom walls smoothly taper from the throat height to the mouth height with respect to the elevation plane; and wherein the throat height is smaller than the mouth height.

16. The horn-type electromagnetic dual-polarized antenna according to claim 12, wherein the plurality of asymmetric radiation patterns are elliptical radiation patterns.

17. The horn-type electromagnetic dual-polarized antenna according to claim 12, wherein the first and third radiation patterns are in a range between about 30 to about 90 degrees, and the second and fourth radiation patterns are in a range between about 15 to about 30 degrees.

* * * * *